US008253582B2

(12) United States Patent
Cho et al.

(10) Patent No.: US 8,253,582 B2
(45) Date of Patent: Aug. 28, 2012

(54) HOME APPLIANCE AND HOME APPLIANCE SYSTEM

(75) Inventors: In Haeng Cho, Changwon-si (KR); Phal Jin Lee, Changwon-si (KR); Hoi Jin Jeong, Changwon-si (KR); Jong Hye Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 410 days.

(21) Appl. No.: 12/568,022

(22) Filed: Sep. 28, 2009

(65) Prior Publication Data

US 2010/0259403 A1 Oct. 14, 2010

Related U.S. Application Data

(60) Provisional application No. 61/168,394, filed on Apr. 10, 2009, provisional application No. 61/223,138, filed on Jul. 6, 2009.

(30) Foreign Application Priority Data

Apr. 10, 2009 (KR) ..... 10-2009-0031503

(51) Int. Cl.
*G08B 21/00* (2006.01)

(52) U.S. Cl. ..... 340/679

(58) Field of Classification Search ..... 340/679, 340/692, 539.26; 379/102.01, 106.01; 68/12.23
See application file for complete search history.

(56) References Cited

U.S. PATENT DOCUMENTS 3,910,322 A 10/1975 Hardesty et al.
4,766,505 A 8/1988 Nakano et al.
4,897,659 A 1/1990 Mellon
5,103,214 A 4/1992 Curran et al.
5,268,666 A 12/1993 Michel et al.
5,452,344 A 9/1995 Larson
5,506,892 A 4/1996 Kojima et al.
5,757,643 A 5/1998 Kuroda et al.

(Continued)

FOREIGN PATENT DOCUMENTS

EP 0 038 687 10/1981

(Continued)

OTHER PUBLICATIONS

International Search Report dated Dec. 1, 2010 (PCT/KR2010/002211).

(Continued)

*Primary Examiner* — Phung Nguyen
(74) *Attorney, Agent, or Firm* — Ked & Associates LLP

(57) ABSTRACT

A home appliance and home appliance system are provided. The home appliance may include an input device, through which an input signal is received from a user, and a control panel, into which the input device is inserted and connected, including a sound through-hole through which sound information passes. The home appliance may further include a sound output device disposed on a rear surface of the control panel that outputs the sound information corresponding to product information of the home appliance through the sound through-hole to outside of the home appliance. A gap may be formed between the input device and the sound through-hole into which the input device is inserted. Therefore, the sound information output from the sound output device may be transmitted to the outside through the gap. The home appliance may further include a sound guide, such that the sound information transmitted from the sound output device may be efficiently transmitted to the sound through-hole.

31 Claims, 12 Drawing Sheets

U.S. PATENT DOCUMENTS

| | | | | |
|---|---|---|---|---|
| 5,774,529 | A | 6/1998 | Johannsen et al. | |
| 5,864,828 | A | 1/1999 | Atkins | |
| 5,940,915 | A | 8/1999 | Nam | 8/159 |
| 5,987,105 | A * | 11/1999 | Jenkins et al. | 379/106.01 |
| 6,121,593 | A | 9/2000 | Mansbery et al. | |
| 6,763,458 | B1 | 7/2004 | Watanabe et al. | 713/100 |
| 6,778,868 | B2 | 8/2004 | Imamura et al. | |
| 6,870,480 | B2 | 3/2005 | Suzuki et al. | |
| 7,135,982 | B2 | 11/2006 | Lee | 340/635 |
| 7,266,164 | B2 | 9/2007 | Jeon et al. | |
| 7,280,643 | B2 * | 10/2007 | Howard et al. | 379/93.37 |
| 7,337,457 | B2 | 2/2008 | Pack et al. | 725/40 |
| 7,439,439 | B2 * | 10/2008 | Hayes et al. | 84/600 |
| 7,509,824 | B2 * | 3/2009 | Park et al. | 68/12.23 |
| 7,648,476 | B2 | 1/2010 | Bock et al. | |
| 7,653,512 | B2 | 1/2010 | Cheung et al. | 702/184 |
| 7,965,632 | B2 | 6/2011 | Sugaya | |
| 8,040,234 | B2 * | 10/2011 | Ebrom et al. | 340/531 |
| 8,045,636 | B1 | 10/2011 | Lee et al. | |
| 2002/0078742 | A1 | 6/2002 | Kim | 73/162 |
| 2002/0116959 | A1 | 8/2002 | Ohta et al. | |
| 2003/0196492 | A1 | 10/2003 | Remboski et al. | 73/593 |
| 2004/0032853 | A1 | 2/2004 | D'Amico et al. | |
| 2004/0132444 | A1 | 7/2004 | Herrmann | |
| 2004/0158333 | A1 | 8/2004 | Ha et al. | |
| 2005/0086979 | A1 | 4/2005 | Son et al. | |
| 2005/0129200 | A1 | 6/2005 | Forrest et al. | 379/93.37 |
| 2005/0134472 | A1 * | 6/2005 | Jang et al. | 340/691.1 |
| 2006/0066758 | A1 | 3/2006 | Higashihara | |
| 2006/0136544 | A1 | 6/2006 | Atsmon et al. | |
| 2007/0189323 | A1 | 8/2007 | Swoboda et al. | |
| 2008/0122648 | A1 | 5/2008 | Ebrom et al. | |
| 2009/0323914 | A1 | 12/2009 | Lee et al. | |
| 2010/0116060 | A1 | 5/2010 | Murayama | 73/593 |
| 2011/0200189 | A1 | 8/2011 | True et al. | |

FOREIGN PATENT DOCUMENTS

| | | | |
|---|---|---|---|
| EP | 0510519 | | 10/1992 |
| EP | 0 617 557 | A2 | 9/1994 |
| EP | 0 691 060 | | 1/1996 |
| EP | 0 742 308 | | 11/1996 |
| EP | 0 846 991 | | 6/1998 |
| EP | 0 851 054 | | 7/1998 |
| JP | 4-358497 | | 12/1992 |
| JP | 2001-353395 | | 12/2001 |
| JP | 2002-000988 | | 1/2002 |
| JP | 2002-011274 | | 1/2002 |
| JP | 2002-045590 | A | 2/2002 |
| JP | 2007-267956 | | 10/2007 |
| JP | 2008-003562 | | 1/2008 |
| KR | 10-1991-0020404 | A | 12/1991 |
| KR | 10-1996-0003308 | A | 1/1996 |
| KR | 10-1997-0019443 | A | 4/1997 |
| KR | 10-0127232 | | 10/1997 |
| KR | 20-1999-0040564 | U | 12/1999 |
| KR | 10-2000-0018678 | | 4/2000 |
| KR | 10-2001-0063913 | A | 5/2001 |
| KR | 10-2001-0055394 | A | 7/2001 |
| KR | 10-2002-0020831 | A | 3/2002 |
| KR | 10-2002-0030426 | A | 4/2002 |
| KR | 10-2002-0039959 | | 5/2002 |
| KR | 10-2004-0050767 | | 6/2004 |
| KR | 10-2004-0095017 | | 11/2004 |
| KR | 10-2005-0062747 | A | 6/2005 |
| KR | 10-2005-0097282 | A | 10/2005 |
| KR | 10-2006-0103011 | | 9/2006 |
| KR | 10-2007-0013090 | | 1/2007 |
| KR | 10-2008-0068447 | | 7/2008 |
| WO | WO 2008/010670 | | 1/2008 |

OTHER PUBLICATIONS

International Search Report dated Dec. 1, 2010 (PCT/KR2010/002222).

International Search Report dated Dec. 18, 2009.

International Search Report dated Dec. 21, 2009.

International Search Report dated Jan. 4, 2010.

PCT International Search Report dated May 26, 2011 issued in Application No. PCT/KR2010/005108.

International Search Report dated Aug. 23, 2010 (Application No. PCT/KR2010/000319).

Creber, R. K. et al.; "Performance of Undersea Acoustic Networking Using RTS/CTS Handshaking and ARQ Retransmission"; Oceans, 2001 MTS/IEEE Conference and Exhibition; Nov. 5-8, 2001; Piscataway, NJ; IEEE, vol. 4; Nov. 5, 2001; pp. 2083-2086 (XP010566758).

European Search Report dated Oct. 14, 2011 issued in Application No. 09 73 8950.

Russian Office Action dated Feb. 7, 2012. (with translation).

U.S. Office Action issued in U.S. Appl. No. 12/431,903 dated Mar. 8, 2012.

U.S. Office Action issued in U.S. Appl. No. 12/431,893 dated Mar. 19, 2012.

U.S. Office Action issued in U.S. Appl. No. 12/432,132 dated Mar. 20, 2012.

U.S. Office Action issued in U.S. Appl. No. 12/757,205 dated Apr. 2, 2012.

International Search Report dated Apr. 25, 2011 issued in Application No. PCT/KR 2010/004407.

United States Office Action dated Dec. 27, 2011 issued in U.S. Appl. No. 12/432,184.

United States Office Action dated Feb. 14, 2012 issued in U.S. Appl. No. 12/431,910.

United States Office Action dated Mar. 1, 2012 issued in U.S. Appl. No. 12/846,040.

U.S. Appl. No. 12/431,893, filed Apr. 29, 2009.

U.S. Appl. No. 12/431,903, filed Apr. 29, 2009.

U.S. Appl. No. 12/431,910, filed Apr. 29, 2009.

U.S. Appl. No. 12/432,111, filed Apr. 29, 2009.

U.S. Appl. No. 12/432,132, filed Apr. 29, 2009.

U.S. Appl. No. 12/551,827, filed Sep. 1, 2009.

U.S. Appl. No. 12/757,339, filed Apr. 9, 2010.

U.S. Appl. No. 12/757,205, filed Apr. 9, 2010.

U.S. Appl. No. 12/757,213, filed Apr. 9, 2010.

U.S. Appl. No. 12/757,232, filed Apr. 9, 2010.

U.S. Appl. No. 12/757,246, filed Apr. 9, 2010.

U.S. Appl. No. 12/603,810, filed Oct. 22, 2009.

U.S. Appl. No. 12/432,184, filed Apr. 29, 2009.

U.S. Appl. No. 13/382,334, filed Jan. 5, 2012.

U.S. Appl. No. 12/842,649, filed Jul. 23, 2010.

U.S. Appl. No. 12/842,679, filed Jul. 23, 2010.

U.S. Appl. No. 12/846,013, filed Jul. 29, 2010.

U.S. Appl. No. 12/846,040, filed Jul. 29, 2010.

U.S. Appl. No. 12/847,272, filed Jul. 30, 2010.

U.S. Appl. No. 12/847,303, filed Jul. 30, 2010.

U.S. Appl. No. 12/847,406, filed Jul. 30, 2010.

U.S. Appl. No. 12/847,284, filed Jul. 30, 2010.

U.S. Appl. No. 12/847,306, filed Jul. 30, 2010.

U.S. Appl. No. 12/850,240, filed Aug. 4, 2010.

U.S. Office Action issued in U.S. Appl. No. 12/432,111, dated May 2, 2012.

European Search Report dated May 8, 2012.

Milica Stojanovic; "Recent Advances in High-Speed underwater Acoustic Communications"; IEEE Journal of Oceanice Engineering, IEEE Service Center; Piscataway, NJ; vol. 21, No. 2; Apr. 1, 1996; pp. 125-136 (XP011042321).

U.S. Office Action issued in U.S. Appl. No. 12/757,246, dated May 18, 2012.

U.S. Office Action issued in U.S. Appl. No. 12/757,339, dated May 22, 2012.

U.S. Office Action issued in U.S. Appl. No. 12/757,213, dated Jun. 25, 2012.

U.S. Office Action issued in U.S. Appl. No. 12/603,810, dated Jul. 5, 2012.

* cited by examiner

HOME APPLIANCE AND HOME APPLIANCE SYSTEM

This application claims priority to U.S. Provisional Application Nos. 61/168,394, filed Apr. 10, 2009, and 61/223,138, filed Jul. 6, 2009, which claims under 35 U.S.C. §119(a) the benefit of Korean Patent Application No. 10-2009-0031503 filed Apr. 10, 2009. The entire contents of all of these documents are incorporated herein by reference.

BACKGROUND

1. Field

A home appliance and home appliance system are disclosed herein.

2. Background

Home appliances and home appliance systems are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Embodiments disclosed herein are directed to a home appliance and a home appliance system. Embodiments of a home appliance and a home appliance system will be described using a laundry treatment machine and a laundry treatment machine system as examples. However, embodiments are not limited to a laundry treatment machine and laundry treatment machine system, but rather, are applicable to other home appliances. Such home appliances may include, for example, a TV, an air conditioner, a washing machine, a refrigerator, an electric rice cooker, or a microwave or conventional oven.

European Patent No. 0510519 discloses a technique for transmitting fault or failure information of a home appliance to a service center using a telephone network via a modem connected to the home appliance. With this technique, the home appliance must be connected to the modem at all times. However, a home appliance, such as a laundry treatment machine, may be installed outside, and thus, there are location restrictions that must be considered when connecting the laundry treatment machine and the telephone network.

U.S. Pat. No. 5,987,105 discloses a technique for converting fault or failure information of a home appliance into a signal tone in an audio frequency band and transmitting the signal tone to a remote service center using a telephone via a telephone network. However, in the process of converting the fault or failure information of the home information into a signal tone in the audio frequency band and transmitting the signal sound to a telephone handset, signal interference may occur due to, for example, environmental conditions. Further, in the process of transmitting the signal sound through the telephone network to the service center, data loss may occur due to characteristics of the telephone network. Moreover, in the process of transmitting the signal sound to the outside, it is necessary to accurately transmit the signal sound to the outside. However, the conventional home appliance has a problem in that the signal sound is attenuated since there is no structure for efficiently transmitting the signal sound to the outside.

Moreover, the signal sound is transmitted through an external terminal to an external controller to provide the current status of the appliance. In this case, if the signal sound is not accurately transmitted from the home appliance, the external controller cannot accurately process the signal sound.

Figure 1:
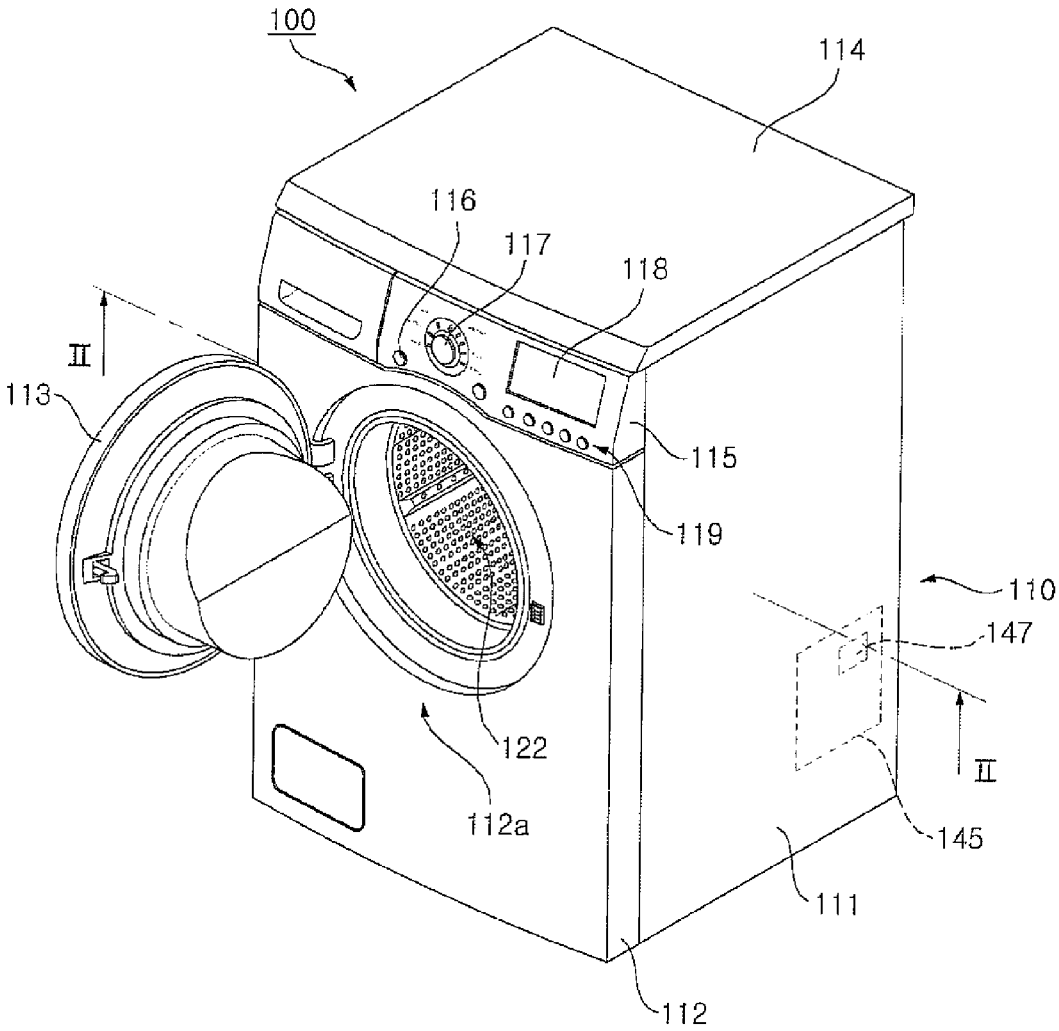
FIG. 1 is a front perspective view of a laundry treatment machine as an exemplary home appliance in accordance with an embodiment.
Figure 2:
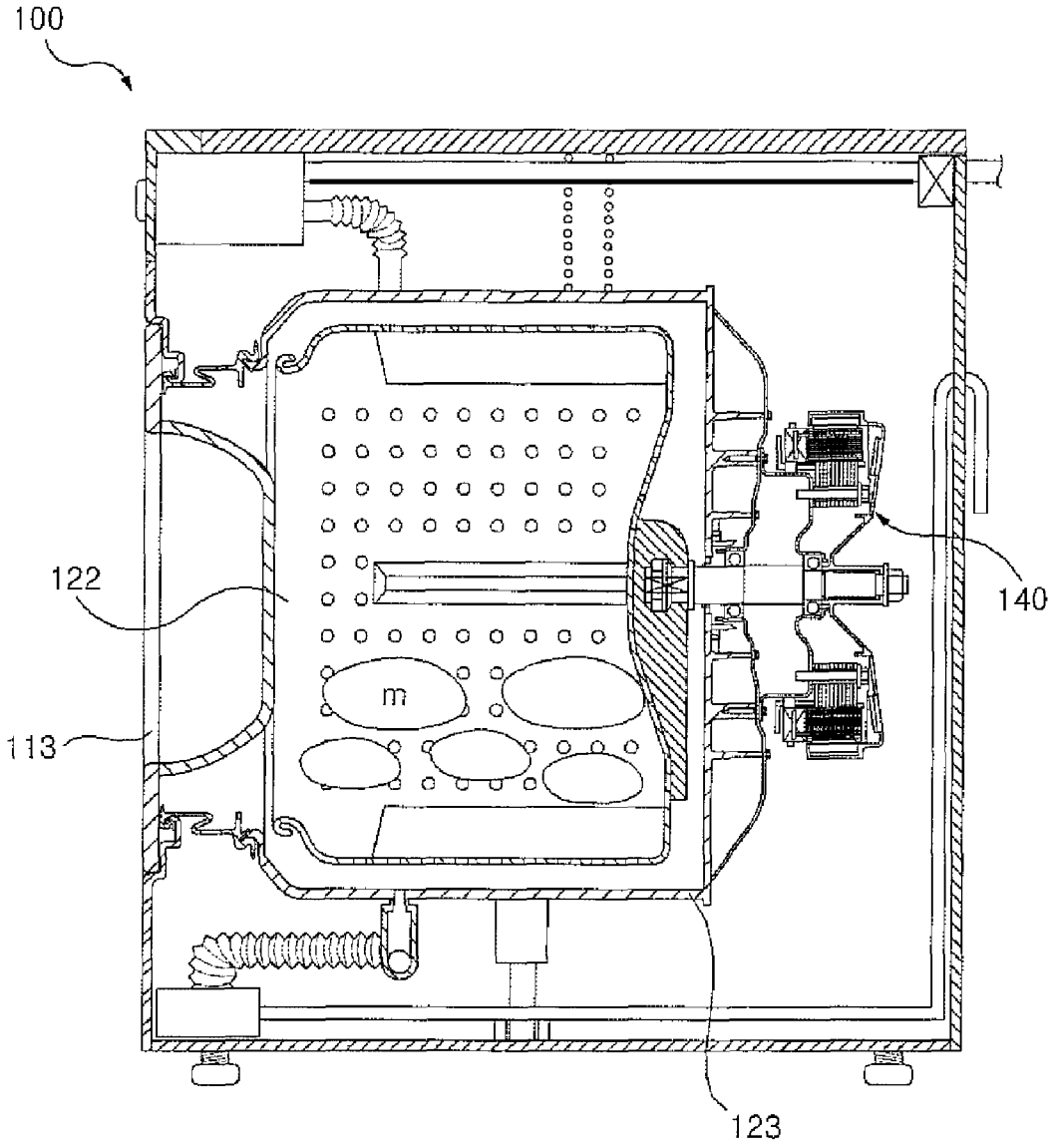
FIG. 2 is a cross-sectional view of the laundry treatment machine of FIG. 1 taken along line II-II.
Figure 3:
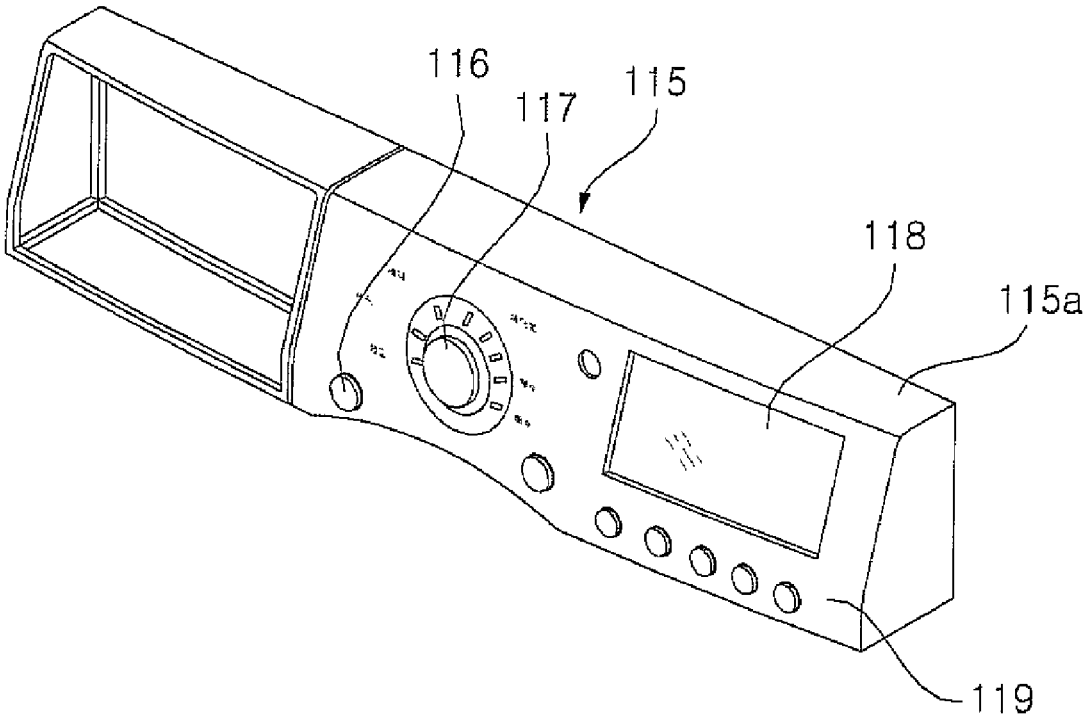
FIG. 3 is a front perspective view of a control panel of the laundry treatment machine of FIG. 1.
Figure 4:
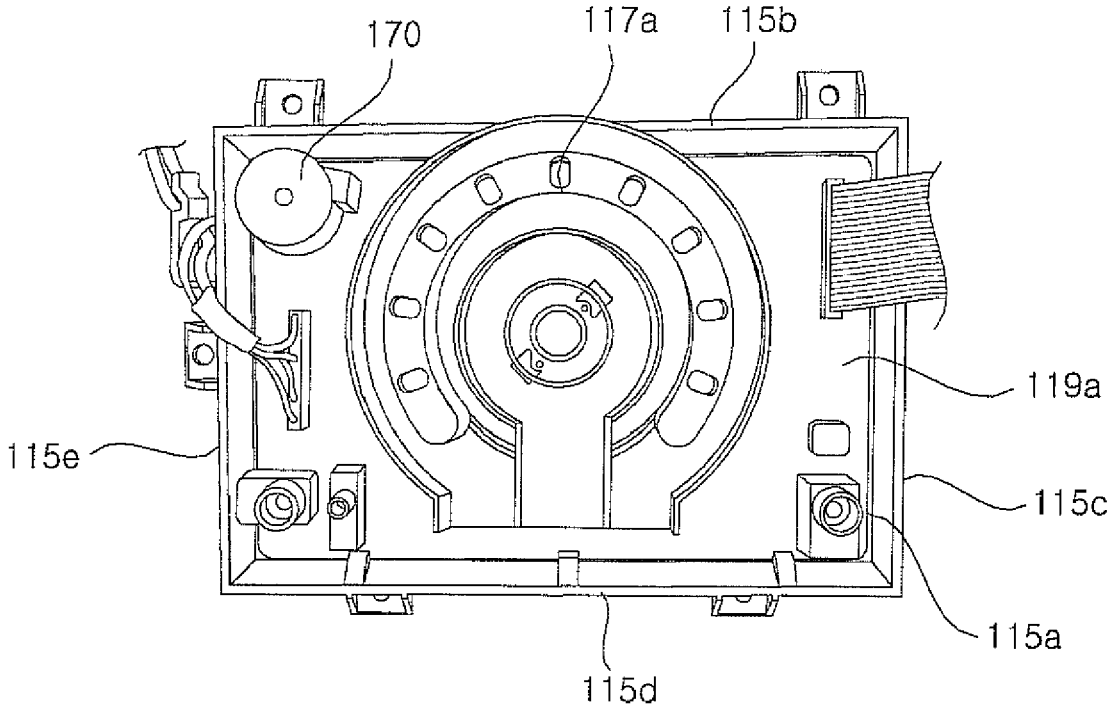
FIG. 4 is a rear perspective view of a portion of the control panel of the laundry treatment machine of FIG. 1.

FIG. 1 is a front perspective view of a laundry treatment machine as an exemplary home appliance in accordance with an embodiment. FIG. 2 is a cross-sectional view of the laundry treatment machine of FIG. 1 taken along line II-II. FIG. 3 is a perspective view of a control panel of the laundry treatment machine of FIG. 1. FIG. 4 is a rear perspective view of a portion of the control panel of the laundry treatment machine of FIG. 1.

Referring to FIGS. 1 to 4, a laundry treatment machine 100 may include a cabinet 110, a tub 123 disposed inside the cabinet 110 that stores washing water, a drum 122 disposed inside the tub 123 configured to receive laundry, a drive 140 connected to the drum 122 that transmits a driving force to the drum 122, a washing water supply device (not shown) that supplies washing water to the drum 122 and the tub 123 from outside of the laundry treatment machine 100, and a drainage device (not shown) that drains the washing water of the tub 123 to the outside of the laundry treatment machine 100. The cabinet 110 may include a cabinet body 111, a cover 112 connected to the cabinet body 111 and having a laundry inlet/outlet hole 112*a*, through which the laundry may be put into and removed from the drum 122, a control panel 115, which may be disposed at a top of the cover 112 and connected to the cabinet body 111, and a top plate 115*b* disposed at a top of the control panel 115 and connected to the cabinet body 111.

The laundry treatment machine 100 may further include a main controller 145, for example, a PCB, and a main sound generating device 147, as shown in FIG. 1. The main controller 145 controls functions of the laundry treatment machine 100. The main sound generating device 147, which may be, for example, a buzzer, is generally provided to provide a sound as a warning sound or alarm, provide a verification signal to a user, and/or provide an audible indication to a user of a certain condition of the laundry treatment machine 100.

The control panel 115 may include a front surface 119, an input device 116 through which an input signal may be received from a user, an operation signal device 117, through which an operation signal may be received from the user, and a display 118 that displays a status of the laundry treatment machine 100 to a user. A display controller (not shown) may be disposed on a rear surface of the display 118, and a body 117*a* may be disposed on a rear surface of the operation signal input device 117. When the user inputs an operation signal through the operation signal input device 117, the body 117*a* of the operation signal input device 117 may generate a signal to transmit the operation signal to a controller (not shown). Meanwhile, the display controller may output a signal corresponding to product information of the laundry treatment machine 100 from the controller to the outside of the laundry treatment machine 100. Therefore, the user may check the status of the laundry treatment machine 100 based on the signal output through the display 118.

A process of assembling the control panel 115 will be described herein below. An assembler may connect a control panel cover or front surface 119 to a control panel body 115*b-e*. The control panel cover 119 and the control panel body 115*b-e* may be connected in various ways. The control panel cover 119 and the control panel body 115*b-e* may be connected using a fixing protrusion and a fixing groove (not shown). Also, the control panel cover 119 and the control panel body 115*b-e* may be connected using a screw. Connection holes, into which the input device 116 and the operation signal input device 117 may be inserted, may be formed on the control panel cover 119 and/or the control panel body 115*b-e*. A sound through-hole 114, through which sound information passes, may be formed on a portion where the input device 116 may be connected. A sound output device 170 may be disposed on the rear surface 119*a* of the control panel body 115*b-e*. The sound output device 170 may be connected to one side of the body 117*a* of the operation signal input device 117. However, a position of the sound output device 170 is not limited thereto. That is, the sound output device 170 may be located at the rear surface 119*a* of the control panel 115 to transmit the sound information to the outside. The sound information may be converted from the product information of the laundry treatment machine 100 and transmitted to the outside.

A process by which the product information may be converted into the sound information utilizing a home appliance and home appliance system, shown as an example as a laundry treatment machine and laundry system, according to embodiments disclosed herein is described hereinbelow. The user may operate the operation signal input device 117 to output the sound information. When the user inputs a signal through the operation signal input device 117, the controller transmits the product information to a converter (not shown). The converter may convert the product information into sound information corresponding to the product information and transmit the sound information to the sound output device 170. The sound output device 170 may then transmit the received sound information to the outside. At this time, the user may bring an external terminal (not shown) of the home appliance system, shown as a laundry treatment system, adjacent to the laundry treatment machine 100, such that the external terminal transmits the sound information to an external controller (not shown) of the home appliance system. The external controller may decode the product information of the laundry treatment machine 100 from the sound information and take necessary measures. The product information may be configured in various ways. That is, the product information may include various information, such as failure information, model information, and similar information. The external terminal may include any means capable of transmitting the sound information to the external controller, such as PDAs, cellular phones, and similar devices. Therefore, the user may easily transmit the product information to the external controller. Next, various methods of transmitting the sound information to the outside will be described hereinbelow.

Figure 5:
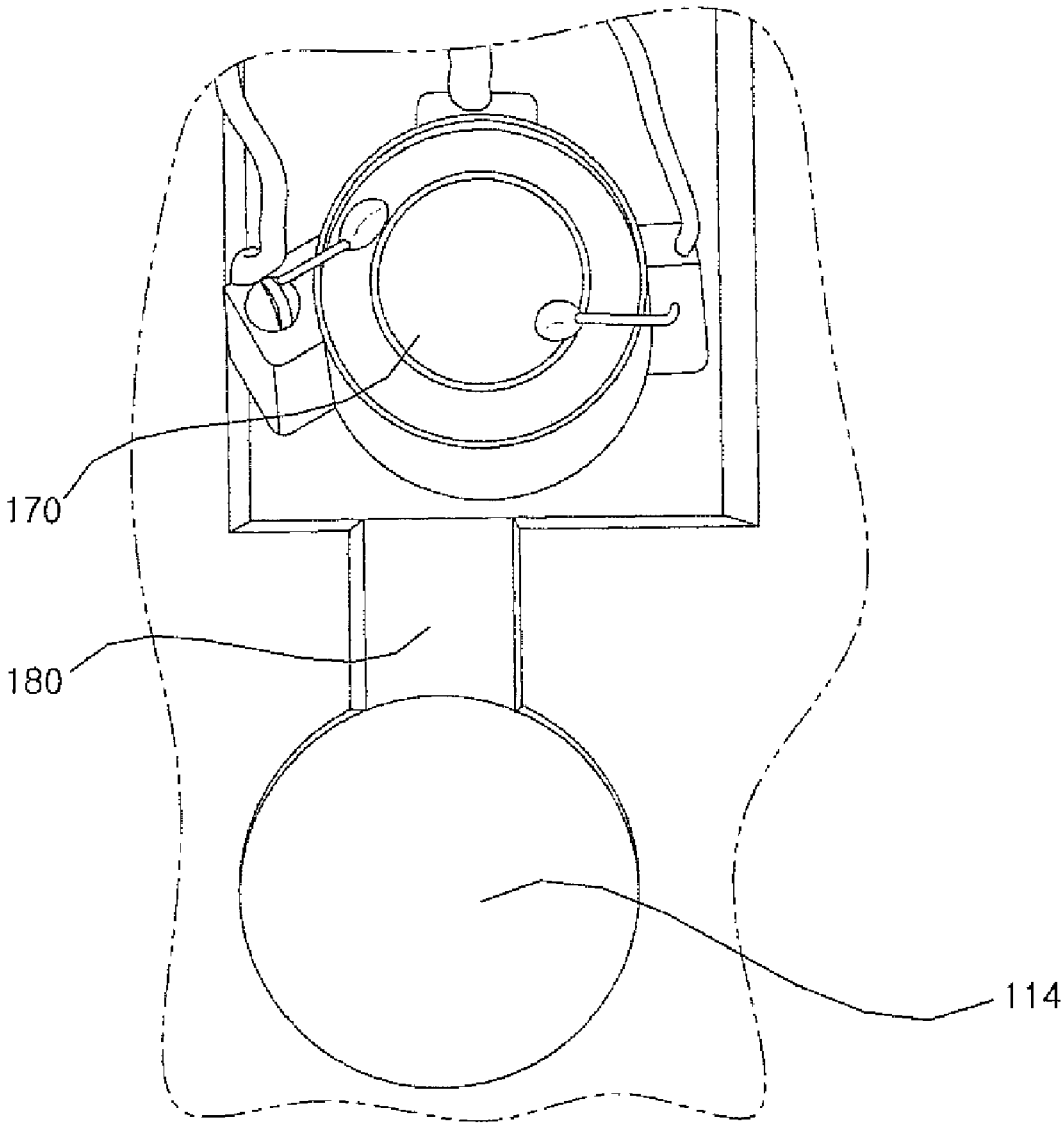
FIG. 5 is a perspective view showing an exemplary sound output device and sound guide according to embodiments.
Figure 6:
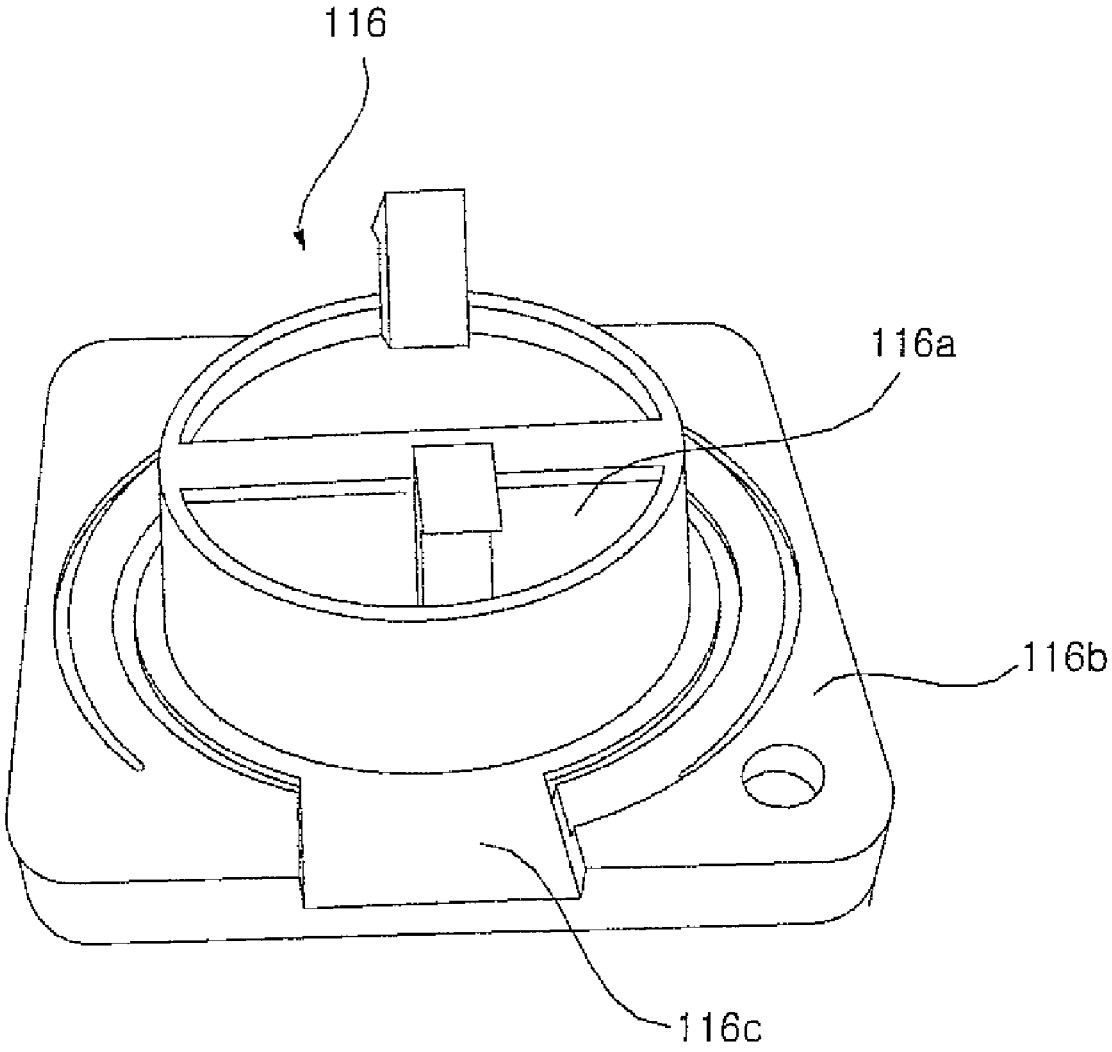
FIG. 6 is a perspective view showing an exemplary input device according to an embodiment.

FIG. 5 is a perspective view showing an exemplary sound output device and sound guide according to embodiments. FIG. 6 is a perspective view showing an exemplary input device according to an embodiment.

Referring to FIGS. 5 and 6, the sound output device 170 may be disposed on the rear surface 119*a* of the control panel 115. Further, a sound guide 180 may be formed on the rear surface 119*a* of the control panel 115, which may guide the sound information output from the sound output device 170 to a sound through-hole 114. The sound guide 180 may include a sound path formed on the rear surface 119*a* of the control panel 115. That is, the sound path 180 may be positioned adjacent to and/or attached to the rear surface 119*a* of the control panel 115. As one side of the sound path 180 may be attached to the rear surface 119*a* of the control panel 115, a portion to which the sound path 180 may be attached may be formed lower than other portions of the control panel 115 or recessed. Meanwhile, the sound output device 170 may be arranged spaced a predetermined distance from the sound through-hole 114.

A process in which the sound information may be transmitted from the sound output device 170 to the sound through-hole 114 will be described herein below. The sound information may be output from the sound output device 170. The sound output device 170 may be arranged spaced a predetermined distance from the rear surface 119*a* of the control panel 115. For example, the sound output device 170 may be within approximately 3 mm of the rear surface 119*a* of the control panel 115, though other distances may also be appropriate. If the sound output device 170 is not spaced a predetermined distance from the rear surface 119*a* of the control panel 115, the sound information output from the sound output device 170 may collide with the control panel 115, and thus, the sound information may be scattered or refracted. As a result, the sound information may not be accurately and clearly transmitted to the outside.

The sound output device 170 may be formed in various ways. That is, the sound output device 170 may include any means capable of transmitting the sound information to the outside. Therefore, the sound output device 170 may transmit sound or voice to the outside. For convenience of description, the sound output device 170 will be described using a buzzer as an exemplary sound output device.

When the sound information is output from the second output device 170, in this embodiment a buzzer, the sound information may be transmitted around the buzzer. Then, the sound information may flow along the sound path 180. The sound path 180 may be formed to extend from the sound output device 170 to the sound through-hole 114. The sound information entering the sound path 180 may be densely aggregated. Therefore, the sound information may be efficiently and accurately transmitted to the sound through-hole 114 through the sound path 180. When the sound information is transmitted to the outside through the sound through-hole 114, the sound information may be transmitted to the external controller via the external terminal. The external controller may determine whether to accurately decode the product information based on an intensity and accuracy of the sound information. However, if the sound path 180 is not provided, the sound information may not be transmitted accurately through the sound through-hole 114. Therefore, the sound path 180 may accurately transmit the sound information to the outside.

The input device 116 may be inserted into the sound through-hole 114 as described above. The input device 116 may include a body 116*b* connected to the rear surface 119*a* of the control panel 115 and a pressing device 116*a* that receives an input signal from the user. When the pressing device 116*a* is inserted into the sound through-hole 114, the body 116*b* may be closely adhered to the rear surface 119*a* of the control panel 115, in which the sound through-hole 114 may be formed. When the body 116*b* is closely adhered to the rear surface 119*a* of the control panel 115, the sound path 180 may be cut off by the body 116*b*. Therefore, one side of the input body 116*b* may be attached to the rear surface 119*a* of the control panel 115, such that the sound information transmitted through the sound path 180 may be transmitted to the outside. That is, although the body 116*b* may be closely adhered to the rear surface 119*a* of the control panel 115, a path through which the sound information may pass may be formed by a portion 116*c* formed at one side of the body 116*b*, and thus, the sound information may be easily transmitted to the outside through the path.

The input device 116 and the sound through-hole 114 may be formed in a circular shape. In such a case, the input device 116 may be inserted into the sound through-hole 114, such that a center of the input device 116 and a center of the sound through-hole 114 may be located at different positions. That is, the input device 116 may be eccentrically inserted into the sound through-hole 114, such that the input device 116 may be closer to one side of the sound through-hole 114. The pressing device 116*a* may be spaced a predetermined distance from an edge of the sound through-hole 114 to form a gap. The sound information may be transmitted to the outside through the gap. In this case, the pressing device 116*a* may be eccentrically inserted into the sound through-hole 114, such that the gap between the pressing device 116*a* and the sound through-hole 114 is greater at one portion than at the other portions. Moreover, the gap may be formed adjacent to the portion 116*c* formed between the sound path 180 and the input device 116. Thus, the gap may accurately guide the sound information to the outside. Therefore, the sound information may be accurately transmitted to the external controller via the external terminal. As a result, the user may accurately provide the status of the laundry treatment machine 100 to a service center.

Meanwhile, the laundry treatment machine 100 in accordance with embodiments disclosed herein is not limited to the above-described structure. That is, the sound through-hole 114 is not limited to one that is connected to the existing input device 116. The sound through-hole 114 may be located at various positions. For example, the sound through-hole 114 may be formed on a side surface 115*b-e* of the control panel 115. Moreover, the sound through-hole 114 may be formed on a front surface 119*a* of the control panel 115. Further, the sound through-hole 114 may be formed on the cabinet 110, instead of the control panel 115. The sound through-hole 114 may be located at an optimal position where the sound information may be output from the laundry treatment machine 100. The sound guide 180 may be formed to accurately guide the sound information from the sound output unit 170 to the sound through-hole 114.

Figure 7:
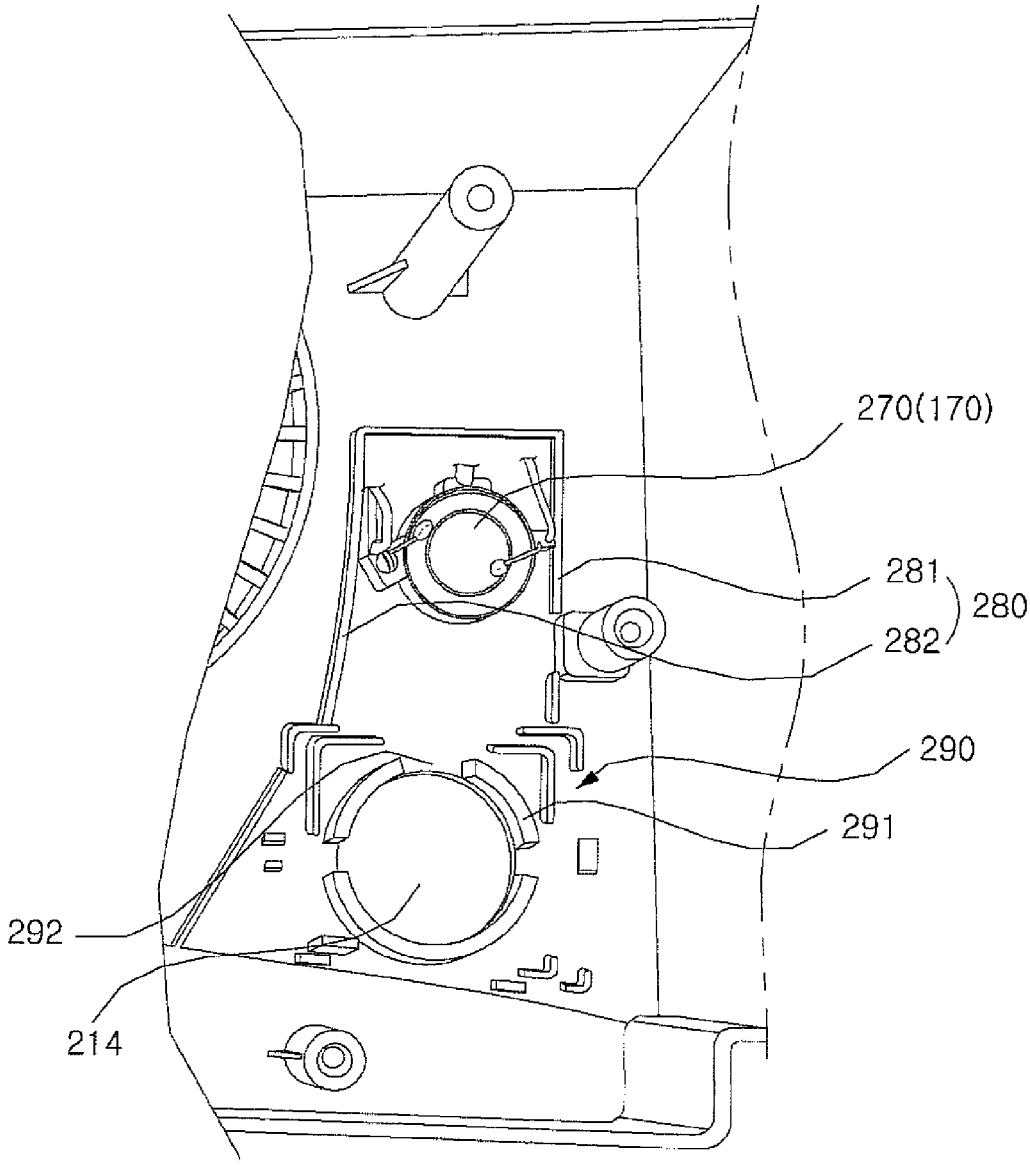
FIG. 7 is a perspective view showing another exemplary sound output device and sound guide according to embodiments.

FIG. 7 is a perspective view showing another exemplary sound output device and the sound guide according to embodiments. Like reference numerals have been used to denote like elements, and repetitive disclosure has been omitted.

Referring to FIG. 7, a sound output device 270 may be disposed on the rear surface 119*a* of the control panel 115 as described above. A sound guide 280 may be provided, which may include one or more sound guide ribs 280. That is, the sound guide 280 may include a first sound guide rib 281 formed on the rear surface 119*a* of the control panel 115 and a second sound guide rib 282 formed to face the first sound guide rib 281. The first sound guide rib 281 may be formed on the rear surface 119*a* of the control panel 115 and may guide the sound information. The second sound guide rib 282 may be arranged to face the first sound guide rib 281, such that the sound information may be accurately guided to a sound through-hole 214. The sound information may be transmitted to the outside through the sound output device 270. The sound information may include the product information of the laundry treatment machine 100 as described above.

A process by which the sound information may flow will be described herein below. When the sound information is transmitted from the sound output device 270, the sound information may collide with the rear surface 119*a* of the control panel 115. The sound information colliding with the rear surface 119*a* of the control panel 115 may be diffused into the rear surface 119*a* of the control panel 115. The first and second sound guide ribs 281 and 282 may guide the sound information. The guided sound information may be transmitted to the outside through the sound through-hole 214 in substantially the same manner as described above.

A waterproof device that prevents washing water from infiltrating into the rear surface 119*a* of the control panel 115 through the second through-hole 214 and that prevents water produced on the rear surface of the control panel 115 from flowing into the input device 116 may be provided for the sound through-hole 214. The waterproof device 290 may be in the form of a waterproof rib 291 formed on the rear surface 119*a* of the control panel 115 and may be disposed around the sound through-hole 214, as shown in FIG. 7. However, the waterproof rib 291 may cut off the sound information transmitted through the sound guide 280. Thus, one side of the waterproof rib 291 may include an open portion 292, such that the sound information may pass through to the sound through-hole 214. The sound information may be transmitted to the sound through-hole 214 through the open side of the waterproof rib 291. The waterproof rib 291 may be, for example, greater than or equal to approximately 1 mm in height. Alternatively, the waterproof device may be in the form of a groove or thinned out portion of the rear surface 119*a* of the control panel 115 to create a channel.

The sound guide 280 may be formed in various ways. As shown in FIG. 7, the sound guide 280 may be formed linearly from the sound output device 270 to the sound through-hole 214. The first sound guide rib 281 may be formed linearly on the rear surface 119*a* of the control panel 115. The second sound guide rib 282 may be formed on the rear surface 119*a* of the control panel 115 and spaced a predetermined distance from the first sound guide rib 281. Further, the first and second guide ribs 281, 282 may be formed as one extending rib.

The first and second sound guide ribs 281 and 282 may not be spaced the same distance from each other. That is, the first sound guide rib 281 may be formed on the control panel 115 at a predetermined distance and angle from a center of the sound output device 270. The second sound guide rib 282 may be formed on the control panel 115 at a predetermined distance and angle from the center of the sound output device 270. In the case where each of the first and second sound guide ribs 281 and 282 is formed on the rear surface 119*a* of the control panel 115 at a predetermined angle, a width between the first and second sound guide ribs 281 and 282 may be smaller at a portion adjacent to the sound output device 270. However, the laundry treatment machine 100 in accordance with embodiments disclosed herein is not limited to the above-described structure. That is, the sound guide 280 may have any shape capable of accurately transmitting sound to the sound through-hole 214.

Therefore, the laundry treatment machine 100 in accordance with embodiments disclosed herein may accurately transmit the sound information to the outside of the laundry treatment machine 100. The sound information accurately transmitted to the outside may be effective in determining accurate product information by the external controller. Moreover, since the sound through-hole 214 may utilize the portion conventionally formed on the control panel 115, it may be possible to accurately transmit the sound information to the outside without change in design.

Meanwhile, the laundry treatment machine 100 in accordance with embodiments disclosed herein is not limited to the above-described structure. That is, the sound through-hole 214 is not limited to that to which the conventionally used input device 116 is connected. The sound through-hole 214 may be formed at various positions. For example, the sound through-hole 214 may be formed on a lateral surface 115*b-e* of the control panel 115. Moreover, the sound through-hole 214 may be formed on a front surface 119 of the control panel 115. Further, the sound through-hole 214 may be formed on the cabinet 110 instead of the control panel 115. The sound through-hole 214 may be located at an optimal position where the sound information is output from the laundry treatment machine 100. The sound guide 280 may be formed to guide the sound information from the sound output device 270 to the sound through-hole 214.

Figure 8:
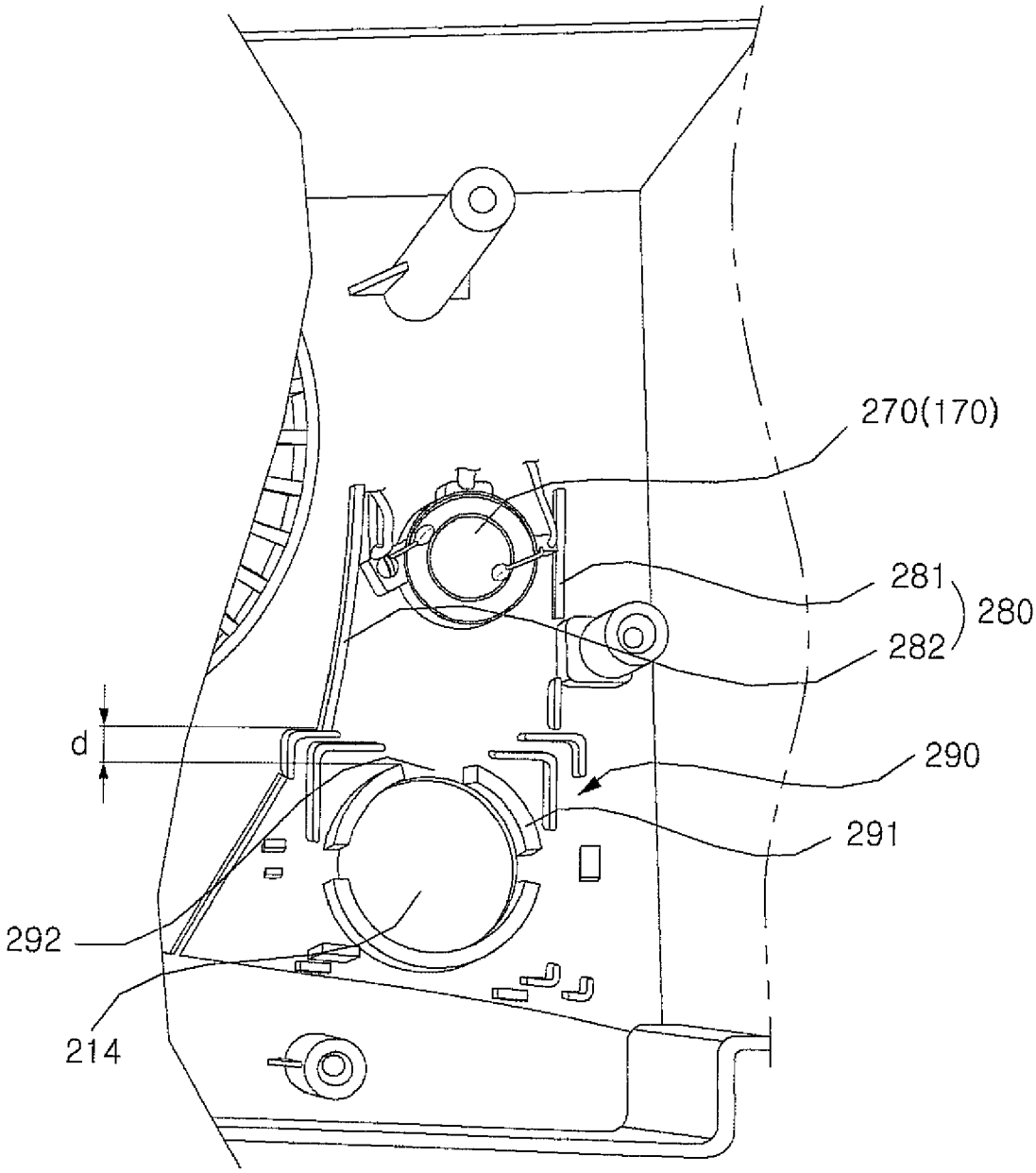
FIG. 8 is a perspective view showing another exemplary sound output device and sound guide according to embodiments.

FIG. 8 is a perspective view showing another exemplary sound output device and the sound guide according to embodiments. Like reference numerals have been used to denote like elements, and repetitive disclosure has been omitted.

The embodiment of FIG. 8 is similar to the embodiment of FIG. 7. However, in this embodiment, the first and second sound guide ribs 281, 282 extend from a first position approximately adjacent a top edge of the sound output device 270, in this embodiment shown as a buzzer, to a second position spaced apart from the sound through-hole 214. A distance d from an ending point of the first and second sound guide ribs 281, 282 (i.e. the second position) to the sound through-hole 214, which may include a waterproof device, shown in this embodiment as waterproof rib 291 having opening 292, may be, for example, approximately 10 mm.

Figure 9:
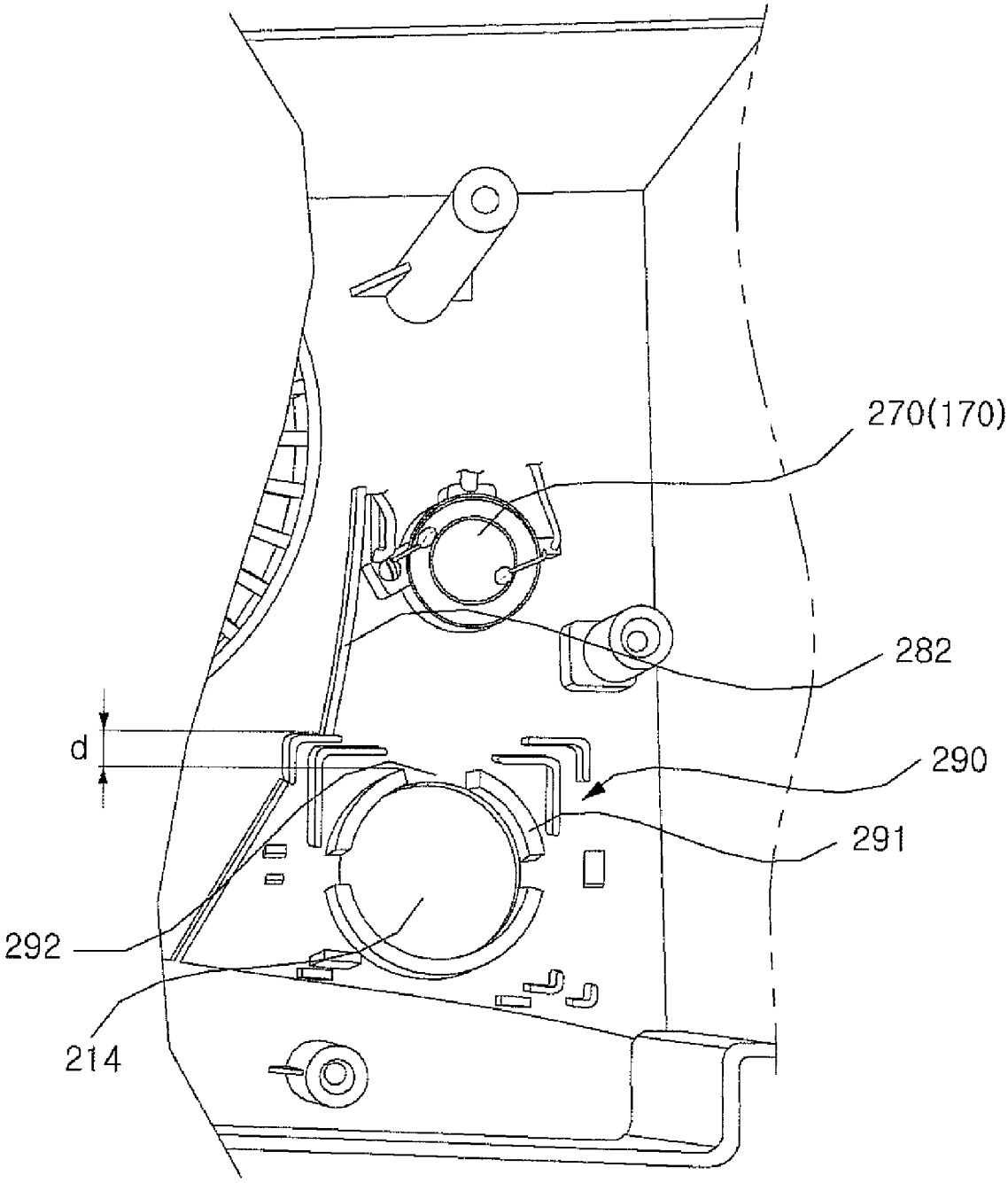
FIG. 9 is a perspective view showing another exemplary sound output device and sound guide according to embodiments.

FIG. 9 is a perspective view showing another exemplary sound output device and the sound guide according to embodiments. Like reference numerals have been used to denote like elements, and repetitive disclosure has been omitted.

The embodiment of FIG. 9 is similar to the embodiment of FIG. 7. However, this embodiment only includes the first sound guide rib 281. The first sound guide rib 281 extends from a first position approximately adjacent a top edge of the sound output device 270, in this embodiment shown as a buzzer, to a second position spaced apart from the sound through-hole 214. A distance d from an ending point of the first sound guide rib 281 to the sound through-hole 214, which may include a waterproof device, shown in this embodiment as waterproof rib 291 having opening 292, may be, for example, approximately 10 mm.

Figure 10:
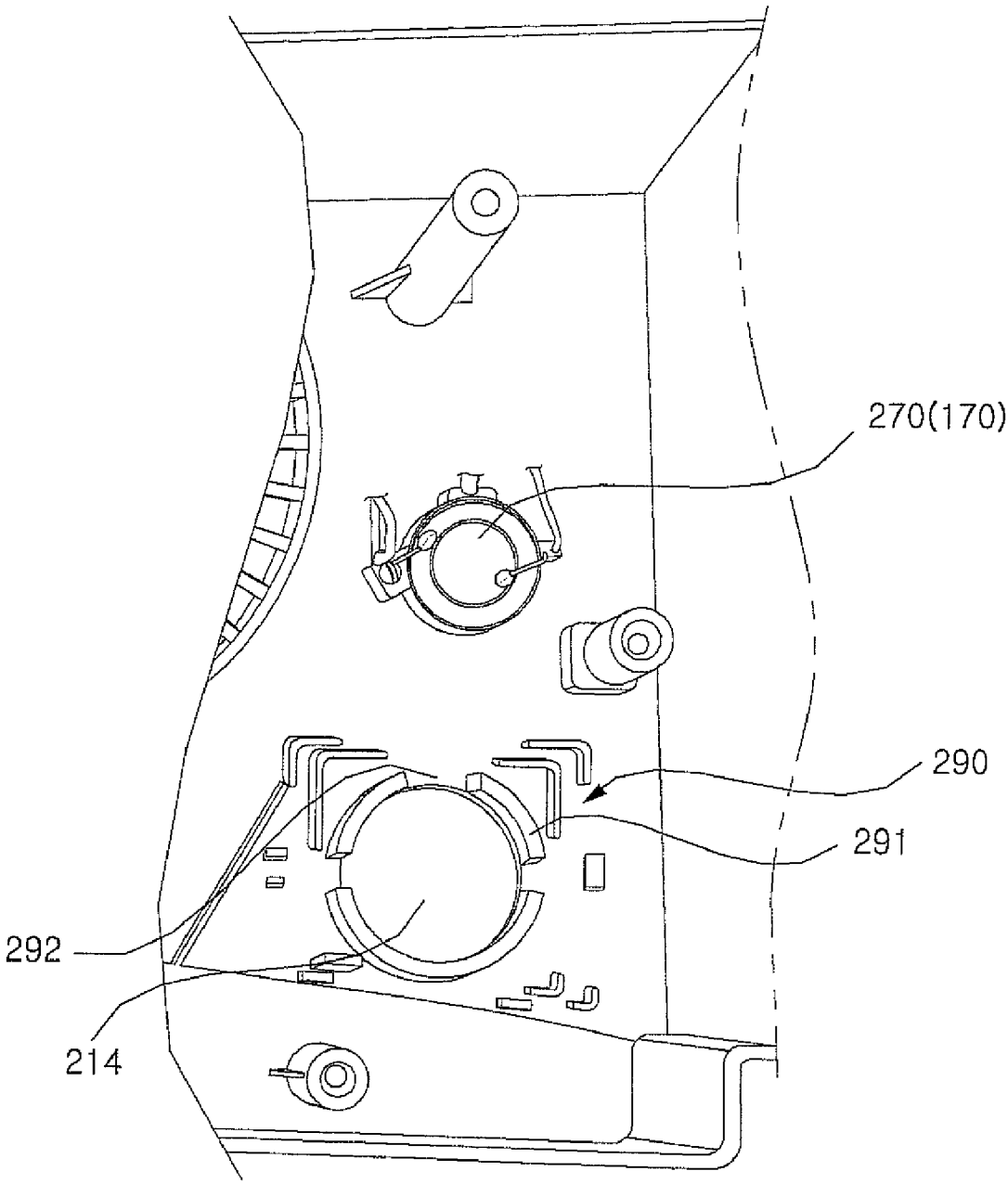
FIG. 10 is a perspective view showing another exemplary sound output device according to embodiments.

FIG. 10 is a perspective view showing another exemplary sound output device according to embodiments. Like reference numerals have been used to denote like elements, and repetitive disclosure has been omitted.

The embodiment of FIG. 10 is similar to the embodiment of FIG. 7. However, this embodiment does not employ the sound guide 280, which may not be necessary to accurately transmit sound to outside of the laundry treatment machine 100.

Figure 11:
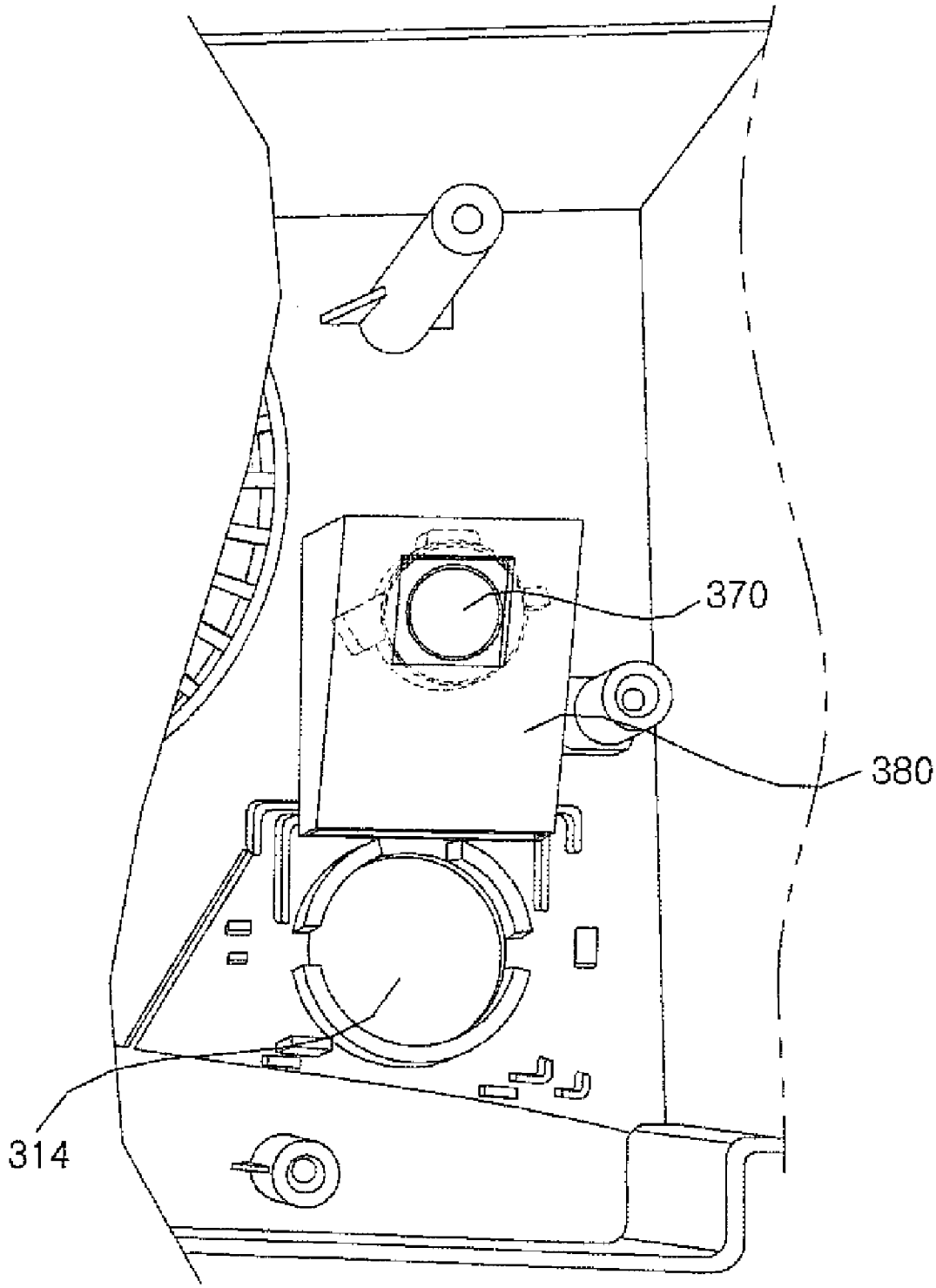
FIG. 11 is a perspective view showing still another exemplary sound output device and sound guide according to embodiments.
Figure 12:
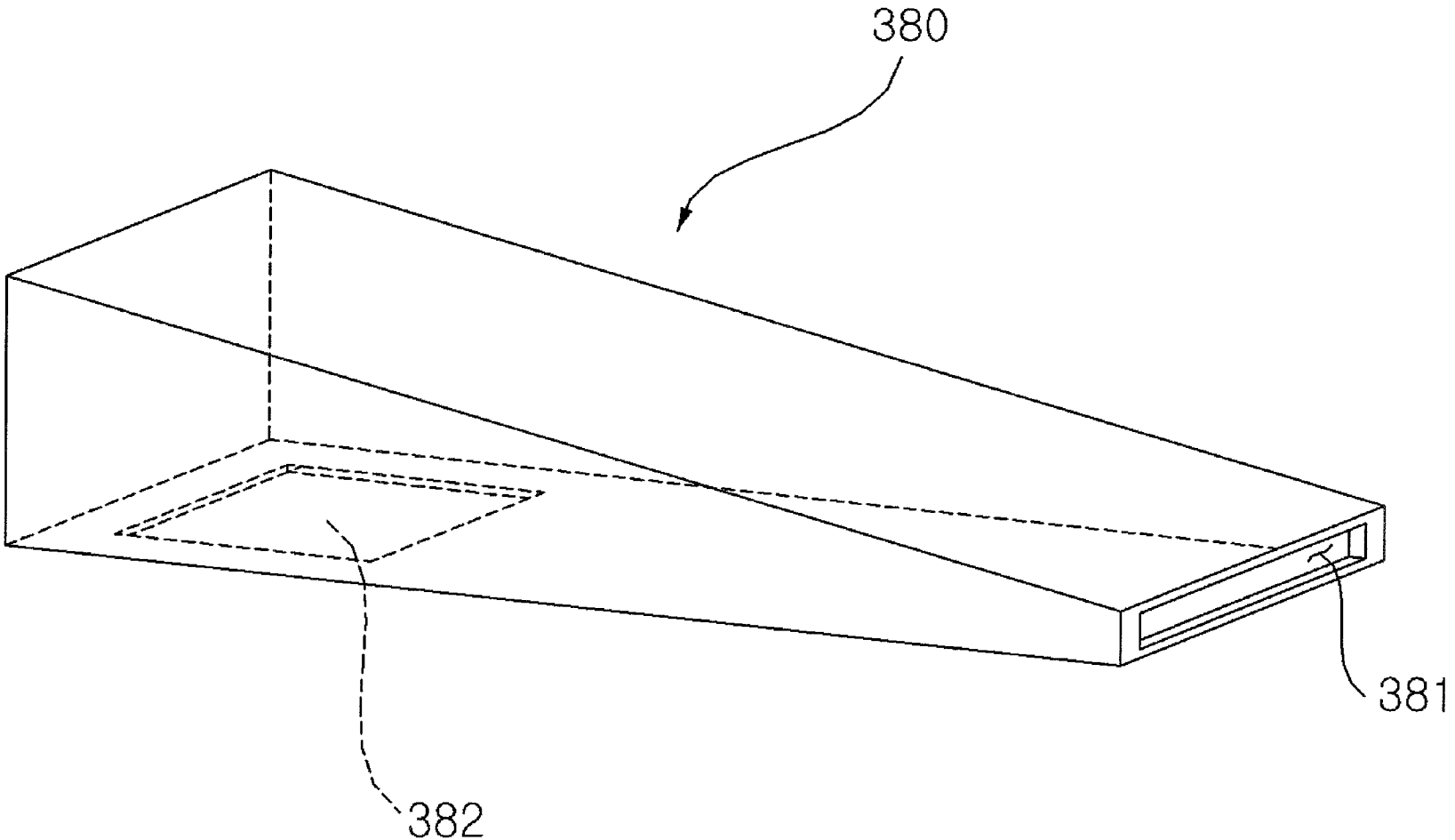
FIG. 12 is a perspective view of a sound guide housing of FIG. 11.

FIG. 11 is a perspective view showing another exemplary sound output device and sound guide according to embodiments. FIG. 12 is a perspective view of a sound guide housing of FIG. 11. Like reference numerals have been used to denote like elements, and repetitive disclosure has been omitted.

Referring to FIG. 11, in the laundry washing machine 100, a sound guide 380 may further include a sound guide housing 380. The sound guide housing 380 may guide the sound information generated from a sound output device 370 to a sound through-hole 314. In the same manner as described above, the sound output device 370 may be disposed on the rear surface 119*a* of the control panel 115. The sound output device 370 may be spaced a predetermined distance from the rear surface of the control panel 115. In this case, one side of the sound guide housing 380 may include an open portion 382, such that a portion of the sound output device 370 may be inserted thereinto. The sound guide housing 380 may include an inner space formed therein, such that the sound information may be transmitted through the inner space. The sound guide housing 380 may include a second open portion 381, such that the sound information may be transmitted to the outside. The second open portion 381 of the sound guide housing 380 may face the sound through-hole 314. Therefore, the sound information may be accurately transmitted from the sound output device 370 to the sound through-hole 314.

A process by which the sound information may be transmitted will be described herein below. As described above, the sound information may be transmitted from the sound output device 370 to the outside of the laundry treatment machine. That is, the sound information may be transmitted to the inner space of the sound guide housing 380 through the first open portion 382 of the sound guide housing 380. The sound information may flow along the inside of the sound guide housing 380 and may then be transmitted to the outside of the sound guide housing 380 through the second open portion 381, which may face the sound through-hole 314 as described above. Therefore, the sound information may flow along the inner space of the sound guide housing 380 and may then be transmitted to the sound through-hole 314. The sound information may be transmitted to the outside through the sound through-hole 314.

The sound guide housing 380 may be formed into various shapes. As shown in FIG. 11, the sound guide housing 380 may have a hexahedral shape. However, the sound guide housing 380 may also have, for example, a quadrangular pyramid shape, or a circular shape. That is, the sound guide housing 380 may include any shape capable of guiding the sound information to the sound through-hole 314 through the inner space. The sound information guided to the sound through-hole 314 may be transmitted to the external controller through the external terminal, as described above. Therefore, the user may accurately transmit the sound information to the external controller via the external terminal. Moreover, in the case where the sound guide housing 380 is provided, it may be possible to prevent the sound information from being distorted.

The laundry treatment machine in accordance with embodiments disclosed herein is not limited to the above-described structure. That is, the sound through-hole 314 is not limited to that to which the conventionally used device 116 is connected. The sound through-hole 314 may be formed at various positions. For example, the sound through-hole 314 may be formed on a lateral surface 115*b-e* of the control panel 115. Moreover, the sound through-hole 314 may be formed on the front surface 119 of the control panel 115. Further, the sound through-hole 314 may be formed on the cabinet 110 instead of the control panel 115. Otherwise, the sound through-hole 314 may be located at an optimal position where the sound information is output from the laundry treatment machine 100. The sound guide housing 380 may be formed to guide the sound information from the sound output device 370 to the sound through-hole 314.

As described above, embodiments disclosed herein efficiently guide sound information corresponding to product information of a home appliance to be transmitted to the outside. Moreover, embodiments disclosed herein transmit the sound information through an existing input device connection hole to the outside, and thus, it may be possible to reduce costs due to change in design.

A home appliance and home appliance system according to embodiments disclosed herein guide sound information to efficiently transmit it to the outside.

A home appliance and home appliance system according to embodiments disclosed herein may include an input device through which an input signal may be received from a user; a control panel, into which the input device may be inserted and connected, including a sound through-hole through which sound information may pass, and a sound output device disposed on a rear surface of the control panel that outputs the sound information corresponding to product information of the home appliance through the sound through-hole to the outside.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine, comprising:

an input device configured to receive an input signal from a user;

a control panel, into which the input device is inserted and connected, the control panel including a sound through-hole;

a sound output device disposed at a rear surface of the control panel, that outputs sound information corresponding to product information of the laundry treatment machine through the sound through-hole to outside of the laundry treatment machine; and a sound guide formed on the rear surface of the control panel that guides the sound information output from the sound output device to the sound through-hole.

2. The laundry treatment machine of claim 1, wherein the sound output device is spaced a predetermined distance from the rear surface of the control panel.

3. The laundry treatment machine of claim 1, wherein the sound output device is spaced within approximately 3 mm of the rear surface of the control panel.

4. The laundry treatment machine of claim 1, wherein the sound output device comprises a buzzer that outputs a sound to the outside.

5. The laundry treatment machine of claim 1, wherein the sound output device is spaced a predetermined distance from one side of the sound through-hole.

6. The laundry treatment machine of claim 1, wherein the input device is inserted and connected into the sound through-hole.

7. The laundry treatment machine of claim 6, wherein a center of the input device and a center of the sound through-hole are located at different positions.

8. The laundry treatment machine of claim 1, wherein the sound guide comprises a sound path formed on the rear surface of the control panel.

9. The laundry treatment machine of claim 8, wherein the sound path is recessed into the rear surface of the control panel.

10. The laundry treatment machine of claim 8, wherein the input device includes a portion, through which the sound information guided into the sound path is transmitted to the outside, formed at one side of the input device.

11. The laundry treatment machine of claim 10, wherein the portion is recessed into the input device, such that the sound information is transmitted to the outside therethrough.

12. The laundry treatment machine of claim 1, wherein the sound guide comprises at least one sound guide rib formed on the rear surface of the control panel, that guides the sound information from the sound output device to the sound through-hole.

13. The laundry treatment machine of claim 12, wherein the at least one sound guide rib comprises a first sound guide rib positioned on the rear surface of the control panel.

14. The laundry treatment machine of claim 13, wherein the first sound guide rib extends from a first position approximately adjacent a top edge of the sound output device to a second position spaced apart from the sound through-hole.

15. The laundry treatment machine of claim 14, wherein a distance from the second position to the sound through-hole is approximately 10 mm.

16. The laundry treatment machine of claim 13, wherein the at least one guide rib further comprises a second sound guide rib, wherein the second sound guide rib is arranged spaced a predetermined distance from the first sound guide rib.

17. The laundry treatment machine of claim 16, wherein the first and second sound guide ribs extend from a first position approximately adjacent a top edge of the sound output device to a second position spaced apart from the sound through-hole.

18. The laundry treatment machine of claim 17, wherein a distance from the second position to the sound-through hole is approximately 10 mm.

19. The laundry treatment machine of claim 12, further comprising a waterproof rib that prevents water flowing from outside of the control panel from infiltrating into the rear surface of the control panel through the sound through-hole.

20. The laundry treatment machine of claim 19, wherein one side of the waterproof rib is open, such that the sound information is transmitted to the outside.

21. The laundry treatment machine of claim 1, wherein the sound guide comprises a sound guide housing configured to receive the sound output device.

22. The laundry treatmant machine of claim 21, wherein at least one side of the sound output device is inserted into the sound guide housing.

23. The laundry treatment machine of claim 21, wherein a predetermined angle is formed between one side of the sound guide housing and the other side thereof.

24. The laundry treatment machine of claim 21, wherein the sound guide housing includes a first opening disposed adjacent the sound output device and a second opening disposed adjacent the sound through-hole.

25. The laundry treatment machine, comprising:

an input device configured to receive an input signal from a user;

a control panel including a sound through-hole, into which the input device is inserted; and a sound output device disposed at a rear surface of the control panel, that outputs sound information corresponding to product information of the laundry treatment machine, wherein the input device is spaced apart from an edge of the sound through-hole to form a gap, such that the sound information is transmitted through the gap to outside of the laundry treatment machine.

26. The laundry treatment machine of claim 25, wherein the sound output device is spaced a predetermined distance from the rear surface of the control panel.

27. The laundry treatment machine of claim 26, wherein the sound output device is spaced within approximately 3 mm of the rear surface of the control panel.

28. The laundry treatment machine of claim 25, wherein the input device is eccentrically inserted into the sound through-hole, such that the input device is closer to one side of the sound through-hole.

29. The laundry treatment machine of claim 25, further comprising:

a sound guide that guides the sound information output from the sound output device to the gap.

30. The laundry treatment machine of claim 29, wherein the sound guide comprises:

a first sound guide rib positioned on the rear surface of the control panel; and a second sound guide rib spaced a predetermined distance from the first sound guide rib, such that the sound information is transmitted along a sound path defined between the first and second sound guide rib.

31. The laundry treatment machine of claim 29, wherein the sound guide comprises:

a first opening disposed adjacent the sound output device, the sound information being introduced through the first opening;

a second opening facing the sound through-hole, through which the sound information being introduced through the first opening is output; and an element forming an inner space of the sound guide, alone which the sound information flows from the first opening to the second opening.

* * * * *